United States Patent [19]

Ueda et al.

[11] 4,051,052

[45] Sept. 27, 1977

[54] LIQUID DEVELOPER

[75] Inventors: Yasuo Ueda, Kobe; Yasutoki Kamezawa; Tatsuo Aizawa, both of Osaka; Toshimitu Ikeda, Himeji, all of Japan

[73] Assignee: Mita Industrial Company Ltd., Osaka, Japan

[21] Appl. No.: 409,737

[22] Filed: Oct. 25, 1973

Related U.S. Application Data

[62] Division of Ser. No. 32,733, April 28, 1970, Pat. No. 3,781,208.

[51] Int. Cl.[2] ..... G03G 9/00

[52] U.S. Cl. ..... 252/62.1 L; 8/1 E; 8/2; 8/2.5 R; 8/39 R

[58] Field of Search ..... 8/39 A, 39 B, 39 C, 8/39 D, 6; 252/62.1

[56] References Cited

U.S. PATENT DOCUMENTS

| | | | |
|---|---|---|---|
| 3,394,133 | 7/1968 | Straley et al. | 8/39 |
| 3,499,896 | 3/1970 | Neeff | 8/39 A |
| 3,642,425 | 2/1972 | Gehrke et al. | 8/39 |
| 3,646,071 | 2/1972 | Frey et al. | 8/39 |
| 3,724,998 | 4/1973 | Gehrke et al. | 8/39 |
| 3,845,080 | 10/1974 | Graser | 8/39 |

*Primary Examiner*—Donald Levy
*Attorney, Agent, or Firm*—Sherman & Shalloway

[57] ABSTRACT

A liquid developer comprising a dispersion of a dye or pigment having a long chain alkyl group in their molecular structure in a liquid hydrocarbon. The liquid developer for electrophotography is excellent in dispersibility of the image-forming dye or pigment particles, uniformity in charge polarity, storage stability, distinct-image forming ability and image-fixing property, and such liquid developer can be prepared without aid of conventional modifiers such as control agents dispersing agents, and fixing agents.

16 Claims, No Drawings

LIQUID DEVELOPER

This is a division, of application Ser. No. 32,733, filed 4/28/70 U.S. Pat. No. 3,781,208.

This invention relates to a liquied developer for electrophotography. More specifically, it relates to a liquid developer for electrophotography which consisits essentially of a dispersion of coloring particles in an electrically insulating carrier liquid.

In electrophotography (inclusive or electrostatic printing), formation of visible images is accomplished by applying charged coloring particles onto an electrostatically charged pattern and converting an electrostatic latent image to an image of coloring particles.

Liquid developers prepared by dispersing a coloring material in a highly dielectric liquid have been used for a long time for formation of visible images from electrostatic latent images. For instance, the early liquid developing methods such as disclosed in the specifications of British Pat. No. 755,486 and French Pat. NO. 1,112,180, include a technique of applying a dispersion of powder which will be electrically drawn, such as carbon black, in a high electric resistance liquid which is an organic liquid such as various hydrocarbons, e.g., carbon tetrachloride and the ordinary insulating oil. *Journal of Scientific Instruments,* Vol. 32, page 74(1955) and ibid, Vol. 33, page 194(1956) discloses dispersions of pigments such as talc, magnesia, carbon black, Monolite Red RS, Monolite yellow GNS, phthalocyanine blue, waxoline nigrosine, zinc oxide, Hansa Yellow, and cadmium sulfide, in a liquid of a high electric resistance such as turpentine oil, gasoline, kerosine, benzene and carbon tetrachloride, and teaches that linseed oil or synthetic resin is further added to these dispersions for controlling charges on coloring particles and fixing visible images.

The specification of Japanese Pat. No. 273,198 (Patent Publication No. 13,424/60)discloses a dispersion of a pigment in a liquid of a high electric resistance and teaches that the pigment is made electrically selective to charges of latent images by coating the pigment with a control agent such as an alkyd resin, linseed oil, synthetic polystyrene rubber or wax rubber.

After the issuance of the above Japanese Patent, various studies have been reported and research made with a view to attaining effective control of charge polarity of coloring particles and improvements in stability of dispersions and fixing property of visible images, and methods have been proposed using various sythetic and natural resins, synthetic resin monomers, primary condensates thereof, surface active agents and the like as the substance to coat coloring particles or to be dissolved in a carrier liquid of a high electric resistance.

The important problems generally involved in liquid developers reside firstly in the uniformity and dispersion stability of charged particles dispersed in the carrier liquid and secondarily in the distinction and fast fixing of images formed by development.

However, these conventional liquid developers are fatally defective with respect to uniformity in charge polarity of dispersed particles, image-fixing property, duration of activity and stability under long time storage.

More specifically, in the case of liquid developers prepared by dispersing dyes or pigments directly in an electrically insulating liquid, resulting visible images of coloring material particles are poor in fixing property and additional operations are necessary for fixing these visible images. Further, since the electrical charges of the dispersed particles of dyes or pigments are not uniform, it is frequently difficult to obtain distinct images.

In the case of liquid developers prepared by using additives such as dispersing assistants in addition to dyes or pigments, an excellent dispersion condition is attained just after dispersing the coloring materials and distinct images can be developed with such liquid developers just after their preparation. However, the balance between the carrier liquid and the coloring material as well as the above-mentioned additives is lost with the lapse of time under continuous usage or storage, resulting in aggregation of coloring material particles, deterioration in electrical properties such as uniformity in charge polarity, precipitation of particles and increasing obscurity in the finished images. Thus, the developers become unsuitable for practical use.

Generally speaking, additives which are excellent as agents for dispersing the coloring material gradually detoriorate the electrical insulating property of the carrier liquid and cause coloring material particles to gradually lose their electrical charges. Further, additives capable of promoting the fixing of coloring material particles often precipitate as the result of oxidation, polymerization, gelation and the like. Still further, control agents used to coat pigment particles not only gradually lose the controlling activity when dissolved in the carrier liquid or separated from the particles, but also induce aggregation and precipitation of particles, making resulting images very indistinct.

Thus, although known liquid developers may possess excellent dispersibility and distinct-image forming ability just after their preparation, from the industrial viewpoint they are fatally defective in that they lack storage stability and they lose reproducibility of images with the lapse of time.

It has now been discovered that, quite independently of the conventional techniques of adding various modifiers such as control agents, dispersing agents, fixing agents and the like to the carrier liquid together with coloring material particles, when specific dyes which will be detailed hereinbelow are dispersed in an electrically insulating liquid, liquid developers for electrophotography can be obtained which are excellent in dispersibility of image-forming particles, uniformity in charge polarity, storage stability, distinctiveness in formed images and image-fixing property and which can produce excellent images with good reproducibility even with the lapse of time.

In accordance with this invention a liquid developer for electrophotography is provided which consists essentially of a dispersion of an anthraquinone dye or pigment, azo dye or pigment, or phthalocyanine pigment substituted by a. an alkyl group,
b. an alkoxy group,
c. a alkylthia group,
d. an alkyl amino group,
e. an alkylcarbonyl group,
f. an N-alkylcarbonamide group,
g. an N-alkylsulfonamide group,
h. an alkarylamino group,
i. an N-alkarylcarbonamide group,
j. an N-alkarylsulfonamide group,
k. an alkylbenzenesulfonamide group,
l. an alkoxyarylamino group, or
m. an alkylamino-triazinylamino group, each of the above groups (a) to (m) having 8 to 24 carbon atoms in the alkyl portion, in a liquid hydrocarbon.

According to this invention, anthraquinone dyes or pigments, azo dyes or pigments, or phthalocyanine pigments substituted by the above-mentioned substitutents having a long chain alkyl portion of 8 to 24 carbon atoms are dispersed in electrically insulating hydrocarbon liquids. When dyes having a specific combination of the above-mentioned substituent and dyestuff skeleton are dispersed in a hydrocarbon liquid, dispersions of these dyes finely and uniformly dispersed in the liquid are obtained, and these dispersions can retain their very stable dispersion state for a long period of time. More specifically, since the dyes or pigments dispersed in the hydrocarbon liquid have in their molecular structure a long chain alkyl group which is an oleophilic group, they can be finely dispersed in the electrically insulating hydrocarbon liquid by their own capacity and the resulting dispersion state is very stable. Although the state of charges of dispersed particles is influenced by the interfacial properties of the dispersed particles and the dispersion medium, in the liquid developer of this invention the dispersion state of the dye or pigment particles is uniform and therefore, the state of charges is also uniform.

Further, the dyes or pigments to be used as coloring material in this invention are prominently excellent in their property of fixing images of originals to be reproduced by electrophotography because of the above-mentioned specific combination of the specific substituent and the specific dyestuff skeleton.

It is quite unexpected that the above-mentioned excellent properties of the liquid developer of this invention can be attained without using any of the conventional control agents, dispersing agents or fixing agents.

In this invention, anthraquinone dyes or pigments having the above-mentioned substituents are conveniently used. These anthraquinone dyes or pigments are prominently excellent in their dispersibility and fixing property. These anthraquinone dyes or pigments may be the following formula (I):

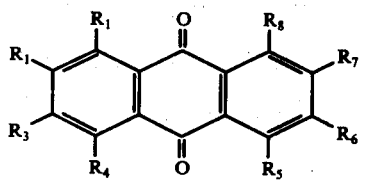

(I)

wherein $R_1$ to $R_8$ are selected from 1. hydrogen,
2. halogen,
3. hydroxyl group,
4. $NH_2$ group,
5. $SO_3M$ group (in which M is hydrogen, an alkali metal or an alkaline earth metal), and
6. a substituent of the group consisting of
   a. an alkyl group,
   b. an alkoxy group,
   c. a alkylthia group,
   d. an alkylamino group,
   e. an alkylcarbonyl group,
   f. an N-alkylcarbonyl group,
   g. an N-alkylsulfonamide group,
   h. an alkarylamino group,
   i. an N-alkarylcarbonamide group,
   j. an N-alkarylsulfonamide group,
   k. an alkylbenzenesulfonamide group,
   l. an alkoxyarylamino group, and
   m. an alkylamino-triazinylamino group,
   each of the above groups (a) to (m) having 8 to 24 carbon atoms, and wherein 1 to 4 of $R_1$ to $R_8$ are substituents selected from the groups (a) to (m).

As such anthraquinone dyes or pigments of formula (1) the following commercially available dyes in addition to those described specifically in examples given hereinbelow may be cited: Carbolan Blue, product of Imperial Chemical Industries, Co.

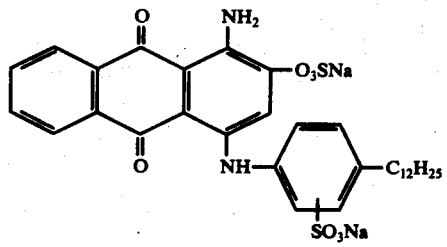

Carbolan Violet 2 R, product of Imperial Chemical Industries,

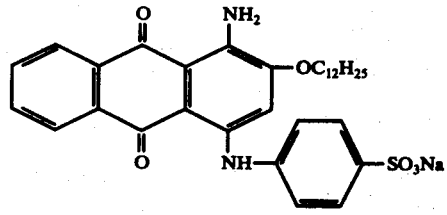

In this invention azo dyes or pigments having the above-mentioned substituents (a) to (m) may be used. These dyes or pigments can be expressed by the following formula (II) or (III):

$$R_1 - A - N = N - A' - R_2)_n \text{(II)}$$

$$\text{or } R_1 - A - N = N - Y - N = N - A' + R_2)_n \text{(III)}$$

wherein A and A' each stand for a benzene, naphthalene or pyrazolone ring which may be substituted by a halogen atom, a hydroxyl group, an amino group, a nitro group, a group $SO_3M$ ( in which M is hydrogen, an alkali metal or an alkaline earth metal), an alkyl or alkoxy group having 1 to 4 carbon atoms or a phenyl group which may be substituted by a halogen atom, a hydroxyl group, an amino group, a nitro group or a group $SO_3M$ ( in which M is as defined above ); $R_1$ and $R_2$ each stand for a. an alkyl group,
b. an alkoxy group,
c. a alkylthia group,
d. an alkylamino group,
e. an alkylcarbonyl group,
f. an N-alkylcarbonamide group,
g. an N-alkylsulfonamide group,
h. an alkarylamino group,
i. an N-alkarylcarbonamide group,
j. an N-alkarylsulfonamide group,
k. an alkylbenzenesulfonamide group,
l. an alkoxyarylamino group, or
m. an alkylamino-triazinylamino group, each of the above groups (a) to (m) having 8 to 24 carbon atoms in the alkyl portion; $n$ is 0 or 1; and Y is an arylene group which may be substituted by an alkyl or alkoxy group of 1 to 4 carbon atoms.

As suitable azo dyes or pigments the following commercially available ones in addition to those described specifically in examples given hereinbelow may be cited:

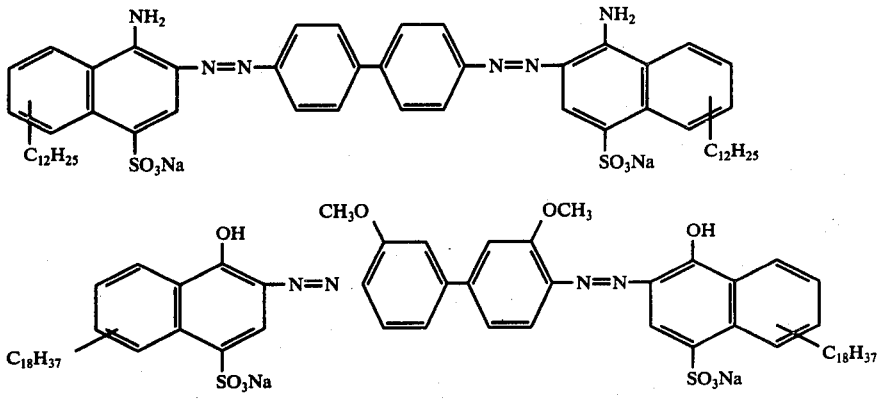

(C. I. Direct Blur 8-$C_{18}H_{37}$; blue )

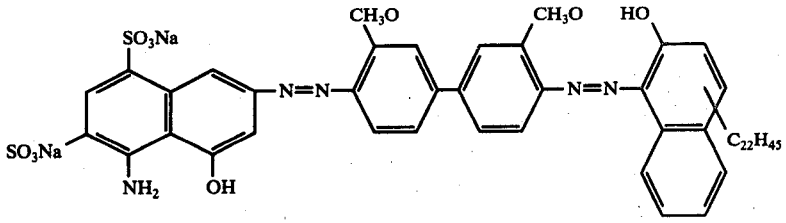

(C. I. Direct Blue 22-$C_{22}H_{45}$; blue)

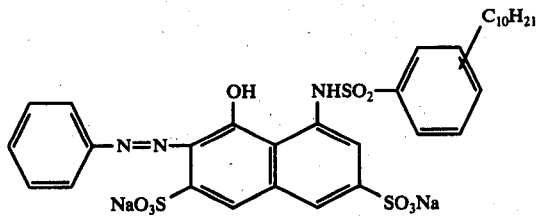

When two rings bonded via the azo group have a hydroxyl group in the position adjacent to the carbon atom to which the azo group is attached, such azo dyes or pigments may be used in the form of complexes with chromium or copper of a metal : dye ratio of 1 : 1 or 1 : 2.

Phthalocyanine pigments conveniently used in this invention have a structure expressed by the following general formula:

(IV)

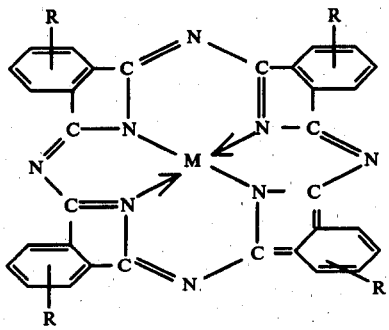

wherein M stands for a divalent metal such as copper and R is a substituent of the group consisting of a. an alkyl group,
b. an alkylcarbonyl group,
c. an N-alkylsulfonamide group, and
d. an N-alkarylsulfonamide group, each of the above groups (a) to (d) having 8 to 24 carbon atoms in the alkyl portion.

Dyes and pigments that are used particularly conveniently in this invention are those having an alkyl group of 8 to 24 carbon atoms bonded directly to a benzene or naphthalene ring. These dyes and pigments have excellent dispersibility in electrically insulating hydrocarbon liquids, and they also have an excellent self-fixing property to electrophotographic recording paper.

Particularly preferred anthraquinone dyes and pigments, are those expressed in above-mentioned general formula (I) wherein 1 to 4 of $R_1$ to $R_8$ are substituents selected from alkarylamino, N-alkarylcarbon, N-alkarylsulfonamide and alkylbenzenesulfonamide groups, each of which has 8 to 24 carbon atoms in the alkyl portion.

Particularly preferred azo dyes and pigments, are those expressed by above-mentioned general formula (II) or (III) wherein $R_1$ and $R_2$ are selected from the group consisting of alkyl, alkarylamino, N-alkarylcarbonamide, N-alkarylsulfonamide and alkylbenzenesulfonamide groups, each of which has 8 to 24 carbon atoms in the alkyl portion.

It is preferable that the alkarylgroup in the above-mentioned substituents is an alkylphenyl group expressed by the formula

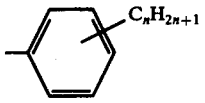

wherein $n$ is an integer of from 8 to 24, such as p-octadecylophenyl, p-dodecylphenyl and p-octadecyl groups.

In the above anthraquinone dyes of formula (I) and azo dyes of formulae (II) and (III), forms of acidic dyes having a sulfonic acid group or a sulfonic acid salt group may be converted to lakes of salts with barium or calcium. The use of such lakes can give a distinct visible image of a high concentration when they are combined with a suitable carrier liquid.

According to this invention, the above-mentioned specific dyes or pigments are dispersed in a liquid hydrocarbon to form liquid developers. In this invention it is unnecessary to use conventional modifying agents such as control agents, dispersing agents and fixing agents, and without the aid of such agents a liquid developer excellent in dispersibility of coloring particles and uniformity of electric charges can be obtained. The liquid developer of this invention can develop an electrostatic latent image to a distinct visible image of good fixing property.

Preferred examples of the liquid hydrocarbon into which the dye or pigment will be dispersed in this invention are straight-chain aliphatic hydrocarbons such an n-hexane and n-octane; aliphatic hydrocarbon mixtures such as naphtha and kerosene; isoparaffin hydrocarbons having a boiling point of 80° to 210° C.; and liquid naphthene hydrocarbons such as cyclohexane. In the examples, Isopar G is a product of Esso Chemicals and is a narrow-cut isoparaffinic hydrocarbon fraction having an approximate boiling range from 320° to 350° F. Isopar G has a typical composition which includes 10.7 weight% $C_9$, 51.4 weight% $C_{10}$ and 29.0 weight% $C_{11}$ isoparaffins. Isopar G has a Kauri butanol value of 27.6 and an aniline point of 181° F (82.8° C). Isopar H is also a product of Esso Chemicals and is also a narrow-cut isoparaffinic hydrocarbon fraction. Isopar H has an approximate boiling range of 345 to 375° F. A typical composition of Isopar H include 0.7 weight% $C_9$, 25.6 weight% $C_{10}$, 54.0 weight% $C_{10}$ and 9.9 weight% $C_{12}$ isoparaffins. Isopar H has a Kauri butanol value of 26.5 and an aniline point of 183° F (83.9° C). Shellsol 71 is a product of Shell Petrochemical Co. containing approximately 100% isoparaffinic hydrocarbons having between 9 and 14 carbon atoms. Shellsol 71 has a boiling point range of from 354° F to 386° F. Shellsol 71 has a Kauri butanol number of 26 and an aniline point of 184° F.

It has now been found that when an aliphatic hydrocarbon containing 5 to 30 % by volume, especially 10 to 30% by volume, of an aromatic liquid hydrocarbon is used as the liquid hydrocarbon in this invention, in development of an electrostatic lalent image a visible image can be obtained with excellent image distinctiveness and fixing property. As the aromatic hydrocarbon benzene, toluene and xylene may be named, and the the above recited aliphatic hydrocarbons may be used in this embodiment.

The concentrations (consistency) of the dye or pigment in the liquid developer may be one usually adopted in the art. For instance, the dye or pigment is dispersed in the liquid hydrocarbon in such an amount that the resulting liquid developer contains 0.05 to 5 grams of the dye or pigment per liter of developer.

The dye or pigment may be finely dispersed in the liquid hydrocarbon medium by dispersing the dye or pigment into a small amount of the medium under ultrasonic vibration or high sheer agitation and diluting the resulting batch with a great amount of the medium liquid.

The liquid developer of this invention can be used as the developer in various electrophotostatic methods. For instance, the liquid developer of this invention can be used for development according to an electrophotographic method using an electrophotographic recording paper comprising a photoconductive layer composed of a photoconductive material and a binder. Suitable recording papers are described in the specifications of U.S. Pat. No. 3,052,539 and British Pat. No. 1,020,506. Furthermore, the liquid developer of this invention may also be applied with good results to development according to an electrophotographic method disclosed in, for instance, the specification of U.S. Pat. No. 2,833,648, in which an electrostatic latent image is transferred to an electrically insulating paper.

EXAMPLE 1

Synthesis:

A reactor was charged with 1.4 g of 1, 5-dichloroanthraquinone, 33.6 g. of stearyl amine, 1.3 g of sodium acetate, 0.3 g of copper acetate and 3.2 g of pyridine and the reaction was effected at 80° C. for 15 hours under stirring. The resulting red solid was dissolved in benzene and insoluble matters were removed, followed by distillation of benzene and recystallization from glacial acetic acid. Thus 1, 5-di-n-octadecylaminoanthraquinone was obtained by the reaction of the following formula:

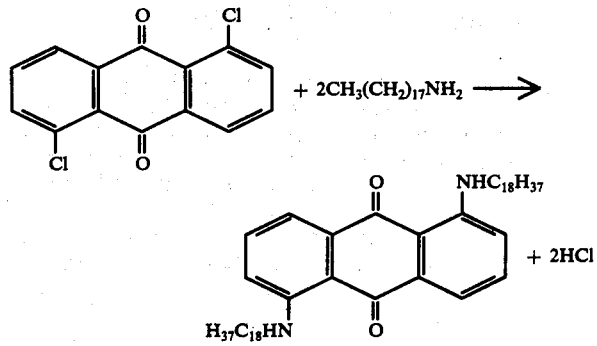

Preparation of Liquid Developer:

A liquid developer was prepared by dispersing 0.2 g of 1,5-di-n-octadecylaminoanthrquinone in 1 liter of n-pentane by means of ultrasonic vibration. Dispersed particles of the so formed liquid developer were positively charged and adsorbed on a negative electrostatic latent image, producing a beautiful pink visible image (positive) of good fixing property. The above dye was dispersed very easily and suitably, and the resulting liquid developer was of good dispersibility.

EXAMPLE 2

Synthesis:

A reactor was charged with 19 g of 1-amino-2,4-dibromoanthraquinone, 28 g of dodecylamine, 0.4 g of copper acetate, 5 g of potassium acetate and 40 g of pyridine and the reaction was effected at an elevated temperature of 115°-120° C. for 20 hours under stirring. The reaction product was dissolved in benzene and insoluble matters were separated, followed by distillation of benzene and recrystallization from glacial acetic acid. A blue solid of 1-amino-2,4-di-n-dodecylaminoanthraquinone was obtained by the reaction of the following formula:

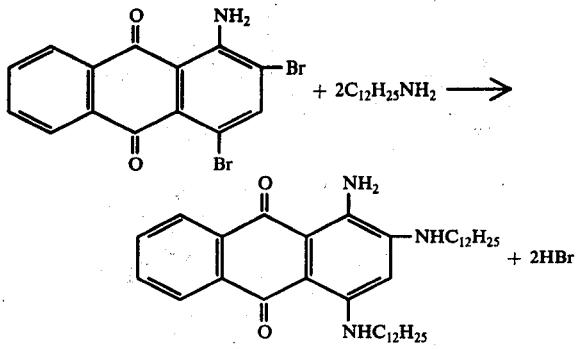

Preparation of Liquid Developer:

A liquid developer was prepared by dispersing 0.2 g of 1-amino-2,4-di-n-dodecylaminoanthraquinone in a mixed solvent of 100 ml of xylene and 900 of Isopar H (product of Esso Standard Petroleum Co.), which is an isoparaffin hydrocarbon, by conducting ultrasonic vibration for 5 minutes. The so formed liquid developer was absorbed onto a negative electrostatic latent image, producing a blue visible image (positive) of good fixing property.

EXAMPLE 3

Sythesis:

A reactor was charged with 10 g of 1-amino-2,4-dibromoanthraquinone, 15 g of p-octadecyl-aniline, 20 g of pyridine, 0.2 g of copper acetate and 2.5 g of potassium acetate, and the reaction was effected at an elevated temperature of 115°-120° C. for 24 hours under stirring. A blue solid of 1-amino-2-bromo-4-p-octadecylanilinoanthraquinone was obtained by the reaction of the formula:

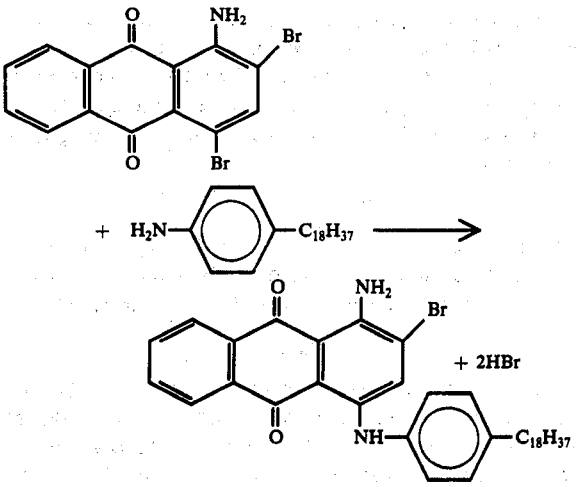

Preparation of Liquid Developer:

A liquid developer was prepared by dispersing 0.2 g of the so formed blue solid in 1 liter of Isopar H (product of Esso Standard Petroleum CO.), which is an isoparaffin hydrocarbon, by means of ultrasonic vibration. The particles in the developer were negatively charged and reversed on a negative electrostatic latent image, forming a blue visible image (negative).

EXAMPLE 4

Synthesis:

A reactor was charged with 9.5 g of 1-amino-2,4-dibromo-anthraquinone, 1.5 g of octadecyloxyaniline, 2.5 g of potassium acetate, 0.2 g of copper acetate and 20 g of pyridine, and the reaction was effected at an elevated temperature of 115°-120° C. for 24 hours. The reaction mixtures was cooled and filtered, after which the recovered precipitate was washed with pyridine, alcohol and then with water, and dried to yield 1-amino-2-bromo-4-p-octadecyloxyanilinoanthraquinone. The reaction is expressed by the following formula:

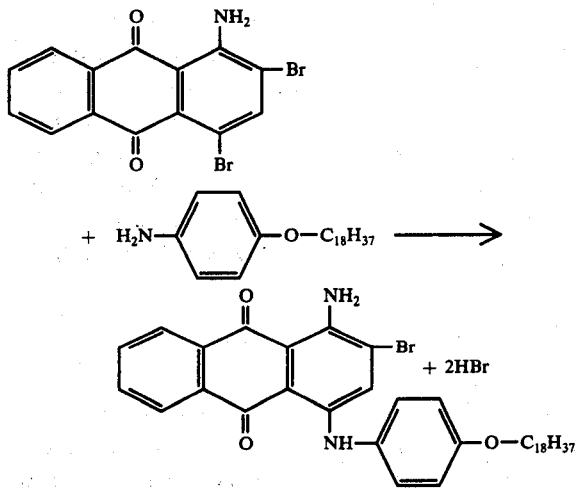

Preparation of Liquid Developer:

A liquid developer was prepared by dispersing 0.2 g of 1-amino-2-bromo-4-p-octadecyloxyanilinoanthraquinone in 1 liter of Shellsol 71, (product of Shell Petroleum Co.), which is an isoparaffin hydrocarbon, by means of ultrasonic vibration. Particles in the so formed liquid developer were negatively charged and reversed on a negative electrostatic latent image to form a blue visible image (negative).

EXAMPLE 5

Synthesis:

A mixture of 56 g of 2-bromo-1-amino-p-dodecylanilino-anthraquinone, 10 g of caustic soda powder and 700 g of p-n-hexadecylphenol was heated at 170°-175° C. for 4 hours. Then, 2000 g of a 5% aqueous solution of caustic soda were added thereto, and the resulting blue precipitate was recovered by filtration, washed sufficiently and dried to yield 1-amino-2-p-n-hexadecylphenoxy-4-dodecylanilinoanthroquinone. The reaction is expressed by the following formula:

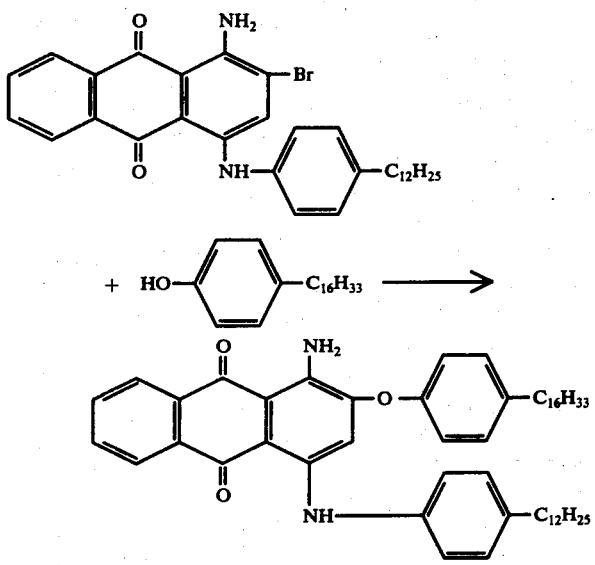

Preparation of Liquid Developer:

A liguid developer was prepared by dispersing 0.2 g of 1-amino-2-p-n-hexadecylphenoxy-4-dodecylanilinoanthraquinone in a mixed solvent of 100 ml of toluene and 900 ml of Isopar G (product of Esso Standard petroleum Co.), which is an isoparaffin hydrocarbon, by means of ultrasonic vibration. The so formed liquid developer was adsorbed onto a negative electrostatic latent image to form a blue visible image (positive).

EXAMPLE 6

Synthesis:

A reactor was charged with 6.7 g of chlorosulfonic acid, and 0.75 g of copper phthalocyanine was gradually added thereto. The mixture was stirred for 30 minutes and heated gradually to 130° C. The reaction was effected at this temperature for 2 -3 hours. The reaction mixture was cooled and gradually added to 500 ml of a saturated aqueous solution of sodium chloride containing ice, followed by filtration. The precipitate was washed with an aqueous solution of sodium chloride containing ice at a temperature low than 5° C. to yield phthalocyanine tetrasulfochloride. Then, 1 g of the so formed phthalocyanine tetrasulfochloride was added to 4 g of octadecylamine molten at 70° C., followed by addition of several drops of pyridine. The reaction was effected for about 1.5 hours under stirring. The reaction mixture was poured into warm water and benzene was added thereto to extract the intended product in benzene. Benzene was removed from the extract by evaporation. The resulting product was purified with glacial acetic acid to yield a blue solid of copper phthalocyanine tetra-N-octadecylsulfonamide.

The reaction of forming the above product is expressed by the following formula:

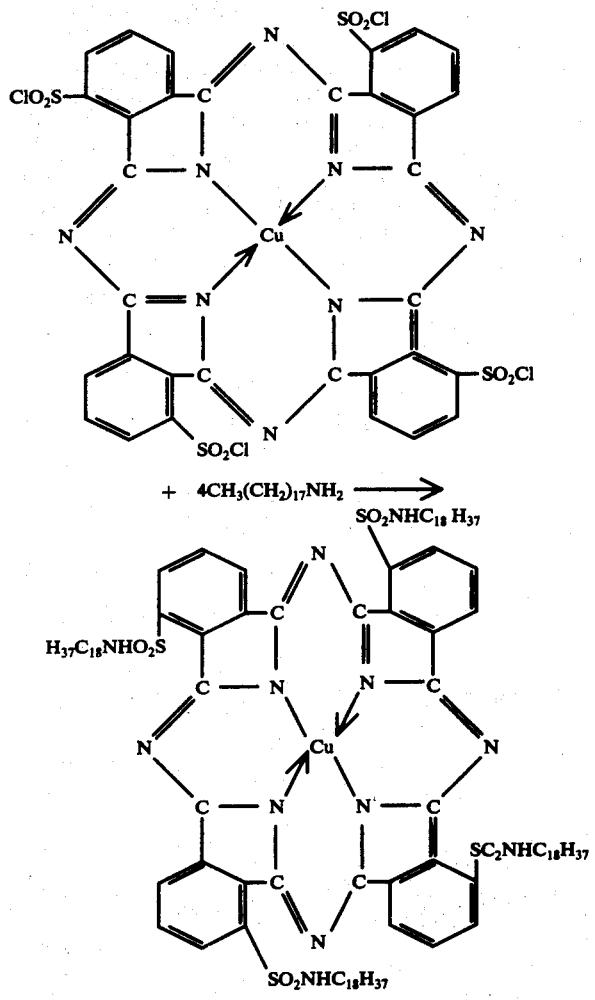

Preparation of Liquid Developer:

Two liquid developers were prepared by dispersing 0.5 g of the so formed blue solid of copper phthalocyanine tetra-N-octadecylsulfonamide in a mixed solvent of 150 ml of Salnesso 100 (product of Esso Standard Petroleum Co.), which is an aromatic hydrocarbon and 850 ml of Isopar H (product of Esso Standard Petroleum Co.), which is an isoparaffin hydrocarbon, or in 1 liter of Whitesol (product of Kyodo Petroleum Co.), which is a petroleum hydrocarbon solvent of an aromatic content of 16%, respectively, by means of ultrasonic vibration. Each of the so prepared liquid developers was reversed on a negative electrostatic latent image, forming a beautiful blue visible image (negative) of good fixing property.

EXAMPLE 7

Example 6 was repeated by employing hexadecyamine instead of octadecylamine. A liquid developer similar to that obtained in Example 6 was obtained.

EXAMPLE 8

When Example 6 was repeated by using 1,2-hydroxyanthraquinone-3-sulfochloride instead of copper phthalocyanine, 1,2-hydroxyanthraquinone-3-octadecylsulfonamide was obtained by the following reaction:

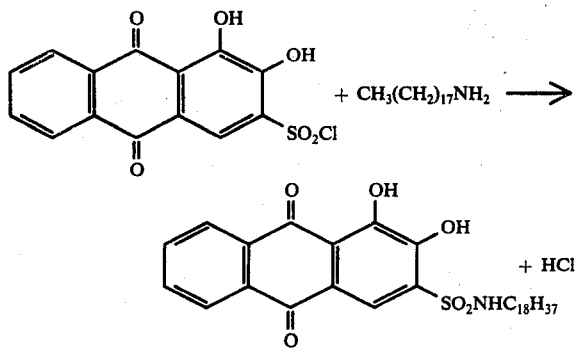

A liquid developer prepared from the above product was reversed on a negative electrostatic image, producing a distinct reddish purple visible image (negative).

EXAMPLE 9

A mixture of 4 g of chrysoidine and 20 g of chlorosulfonic acid was stirred at a temperature lower than 20° C. for 2 hours and poured in ice water to salt out chrysoidine sulfochloride. Then 5 g of chrysoidine sulfochloride were reacted with 20 g of stearyl amine molten at 70° C. The reaction product was extracted with benzene and benzene was evaporated yield the intended chrysoidine-N-stearylsulfonamide. A liquid developer was prepared by dispersing 0.1 g of the resulting product in 1 liter of Shellsol 71 (product of Shell Petroleum Co.), which is an isoparaffin hydrocarbon, by effecting ultrasonic vibration for 2 minutes. This liquid developer was excellent in dispersibility and gave a yellow visible negative image of good fixing property.

For comparison, a liquid developer was prepared in the same manner as above by using 0.1 g of chrysoidine powder. This comparative developer was very inferior in dispersibility and fixing property and gave an indistinct yellowish brown image.

The above reaction of forming chrysoidine-N-stearylsulfonamide is expressed by the following formula:

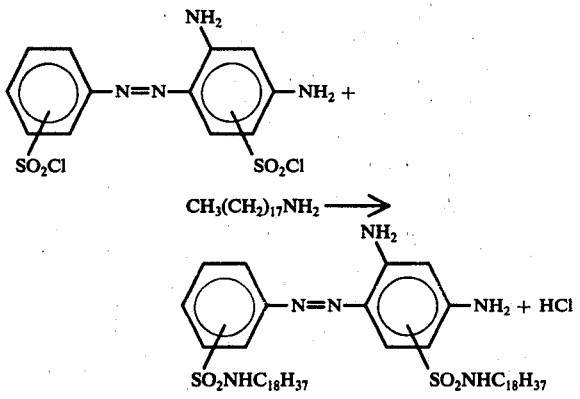

EXAMPLE 10

Synthesis:

A reactor was charged with 3.4 g 2-dodecylamino-4-,6-dichloro-S-triazine, 2.6 g of celliton blue and 100 g of nitrobenzene, and the reaction was effected at an elevated temperature of 130°-135° C. for 1 hour. The reaction mixture was allowed to cool overnight. The precipitated product was recovered by filtration, washed with acetone and dried to yield a blue substance.

The above reaction is expressed by the following formula:

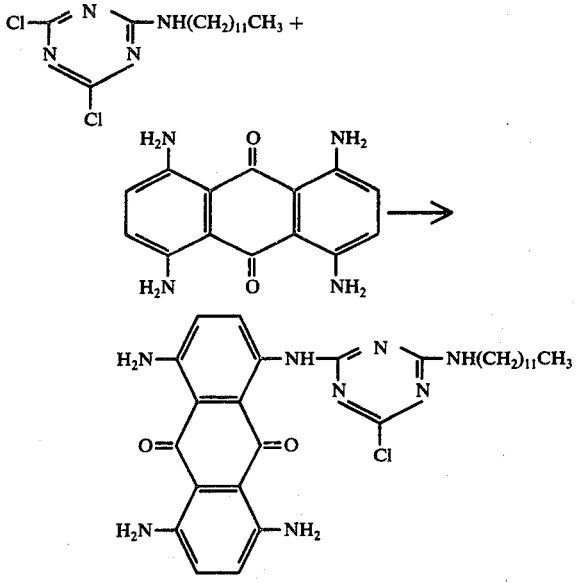

Preparation of Liquid Developer:

A blue liquid developer was prepared by dispersing 0.1 g of the so formed blue substance in 1 liter of New Sol Delux (product of Nippon Petroleum Co.), which is a petroleum hydrocarbon solvent of an aromatic content of 8.2%, by means of ultrasonic vibration. This liquid developer was excellent in dispersibility and reversed on a negative electrostatic latent image to form a blue visible negative image of good fixing property.

EXAMPLE 11

Synthesis:

A reactor ws charged with a solution of 9.2 g of 2,4,6-trichloro-S-triazine in acetone, and a solution of 13.5 g of octadecylamine in acetone was added thereto while the temperature was being maintained at 0°-5° C. by cooling the reactor with ice from the outside. Then, an aqueous solution of sodium carbonate was gradually added and the reaction was effected at 0°-5° C. for 3 hours. The reaction mixture was allowed to stand overnight, and was poured into water. The resulting precipitate was recovered by filtration. 4.2 g of the so obtained 2-octadecylamino-4,6-dichloro-S-triazine and 2.7 g of celliton blue were dissolved in o-dichlorobenzene, and the reaction was effected at 150° C. for 4 hours under stirring. The reaction mixture was cooled and poured into petroleum ether, followed by filtration and washing with acetone to yield a blue powder. 3.2 g of the resulting blue power were dissolved in 100 ml of dioxane, and 0.4 g of monoethanolamine was added thereto. The reaction was effected at the boiling point under stirring. The reaction mixture was added to water, and the precipitate was recovered by filtration, washed with benzene and dissolved in acetone by heating. Insoluble matters were separated and then the liquid was cooled. The resulting precipitated blue particles were recovered by filtration and dried.

The above reaction of forming blue particles is expressed by the following formula:

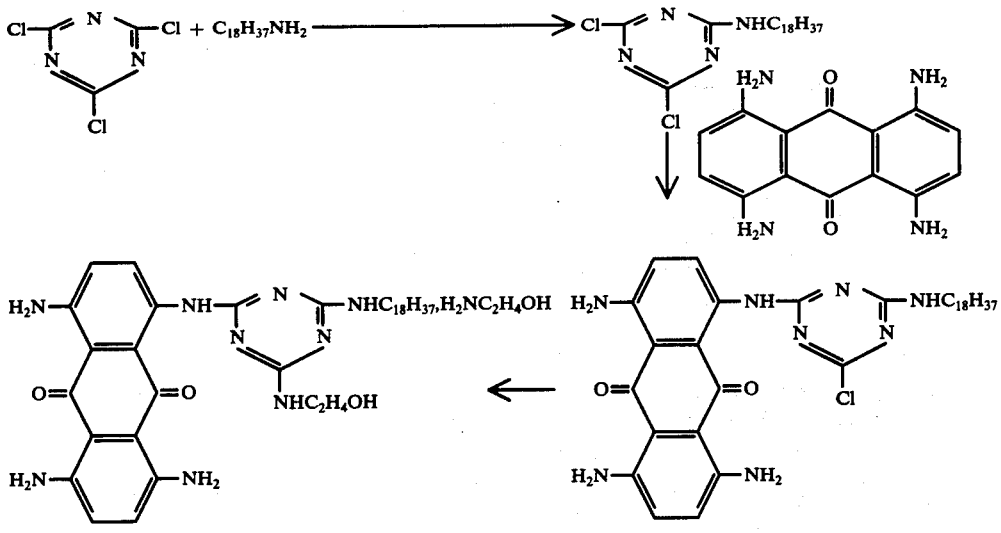

Preparation of Liquid Developer:

A blue liquid developer of an excellent dispersibility was prepared by dispersing 0.2 g of the so formed blue particles in a mixed solvent of 200 ml of benzene and of Isopar H (product of Esso Standard Petroleum Co.), which is an isoparaffin hydrocarbon, by means of ultrasonic vibration. This liquid developer was reversed on a negative electrostatic latent image, producing a blue visible negative image of good fixing property.

EXAMPLE 12

Synthesis:

A reactor was charged with 1.4 g of 2,4,6-trichloro-S-triazine dissolved in 50 ml of acetone, and 2 g of celliton blue were dissolved therein while the reactor was being cooled from the outside with ice. The reaction was effected at 0°-5° C. for 5 hours. Then a solution of 0.4 g of sodium carbonate in 10 ml of water was added, and the reaction was carried out for 2 hours. The reaction mixture was poured in water, and the precipitate was recovered by filtration and washed with acetone to yield a blue substance. A reactor was charged with 2 g of the so formed blue substance, 2.6 g of stearylamine and 100 ml of o-dichlorobenzene, and the reaction was effected at a temperature of 140° C. for 4 hours to obtain a faintly blue substance.

The reaction of forming the above blue product is expressed by the following formula:

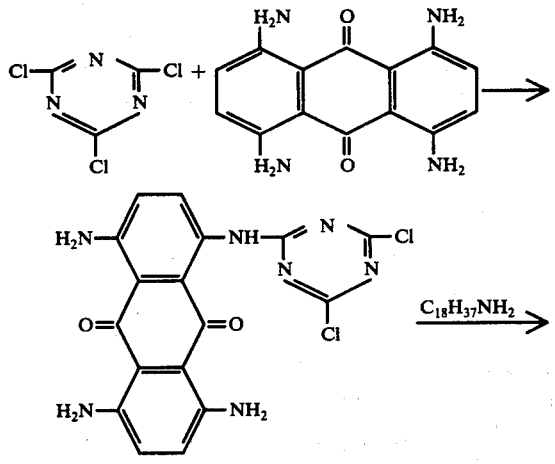

-continued

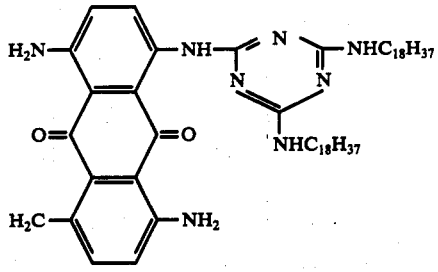

Preparation of Liquid Developer:

A liquid developer was prepared by dispersing 0.2 g of the so formed blue substance in a mixed solvent of 200 ml of toluene and 800 ml of Isopar G (product of Esso Standard Petroleum Co.), which is an isoparaffin hydrocarbon, by means of ultrasonic vibration. This liquid developer was very excellent in dispersibility, and particles of the developer were adsorbed onto a negative electrostatic latent image, forming a beautiful blue visible image (positive).

EXAMPLE 13

Synthesis:

A reactor was charged with 30 g of stearyl chloride, 15 g of anhydrous aluminum chloride and 100 g of dried carbon tetrachloride, and 5 g of phthalocyanine blue were added thereto at an elevated temperature of 30°-35° C. under stirring. The reaction was effected at this temperature for 4 hours under stirring. The reaction mixture was poured in water to decompose aluminum chloride. Then the mixture was washed several times with water and poured into acetone. The resulting precipitate was recovered by filtration, washed with warm ethanol and dried to obtain a blue product of tetra-octadecanoylphthalocyanine.

The reaction of forming the above blue product is expressed by the following formula:

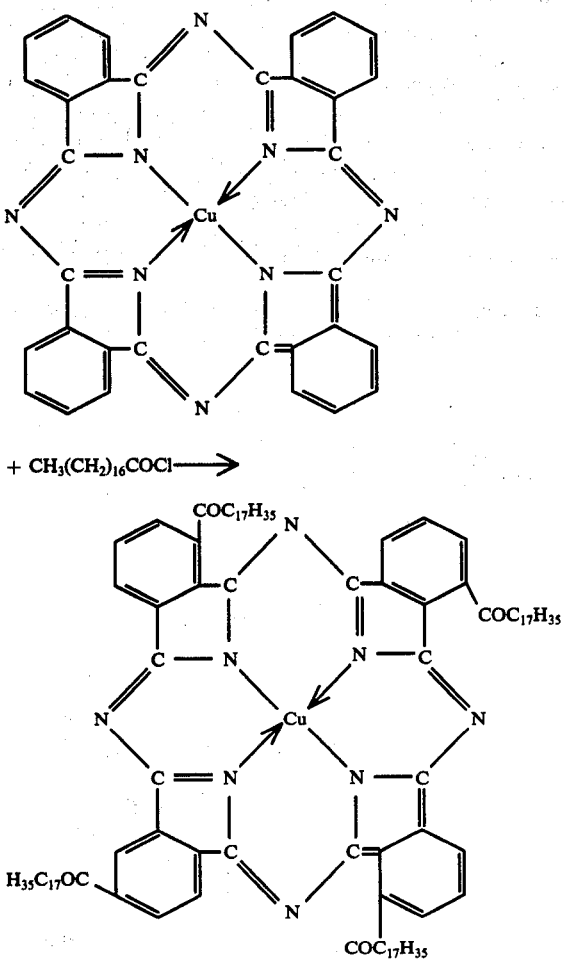

Preparation of Liquid Developer:

A liquid developer was prepared by dispersing 0.2 g of the blue product in a mixture of 300 ml of xylene and 700 ml of Isopar G (product of Esso Standard Petroleum Co.), which is an isoparaffin hydrocarbon solvent, by effecting ultrasonic vibration for 5 minutes. The liquid developer has superior particle dispersibility,image distinctiveness and image fixing property than the liquid developer prepared without addition of xylene, which is an aromatic solvent. Particles in the above developer were adsorbed onto a negative electrostatic latent image, forming a beautiful blue visible image (positive).

EXAMPLE 14

Synthesis:

41 g of metanilic octadecanoylamide prepared by reducing the reaction product of 1-nitrobenzene-3-sulfonamide and stearyl chloride was dissolved in glacial acetic acid and diazotized with 25 g of 30 % hydrochloric acid and 7 g of nitrous acid. The diazotized liquid was added to a liquid containing 1-(2',5'-dichloro-4'-sulfonium)-3-methyl-5-pyrazolone and a suitable amount of caustic soda. The precipitating dye was recovered by filtration, washed and dried to yield the intended product.

The reaction of forming the above product is expressed by the following formula:

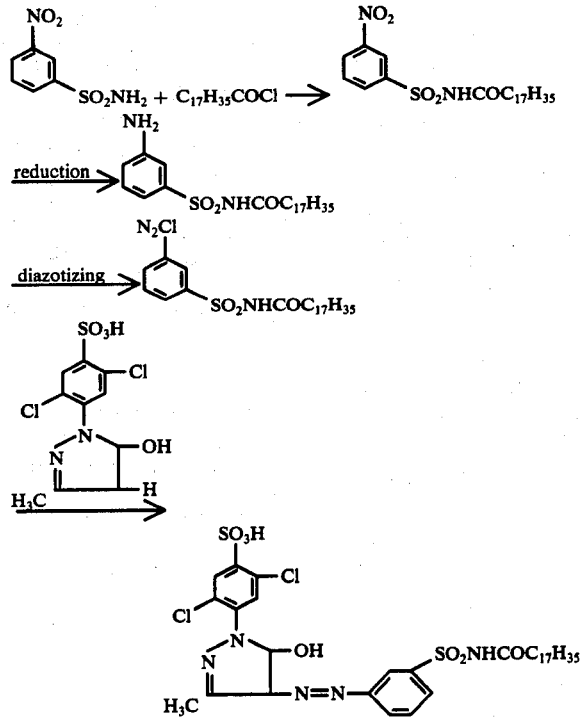

Preparation of Liquid Developer:

A liquid developer was prepared by dispersing 0.2 g of the product in 1 liter of Whitesol (product of Kyodo Petroleum Co.), which is a petroleum hydrocarbon solvent of an aromatic content of 16%, by means of ultrasonic vibration. The particles of the liquid developer were absorbed onto a negative electrostatic latent image, producing a beautiful yellow visible image (positive).

EXAMPLE 15

Synthesis:

34.3 g of octadecylainline, 250 g of 36% hydrochloric acid and 300 g of water were mixed together at 50° C. After the mixture was cooled to 5° C., the diazotization was effected with 10% nitrous acid, followed by coupling with H acid to yield the intended blue dye.

The reaction of forming the blue dye is expressed by the following formula:

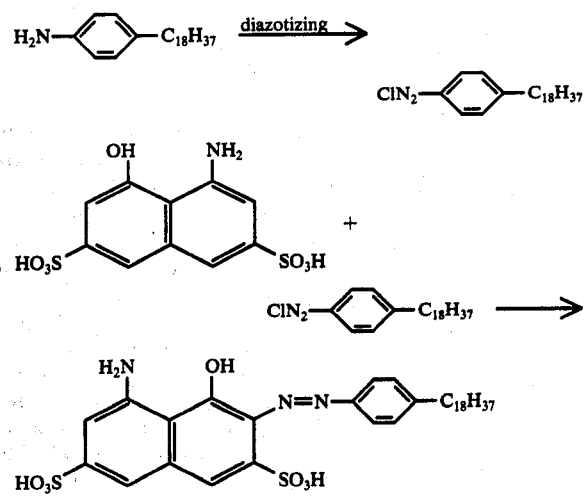

Preparation of Liquid Developer:

A liquid developer was prepared by dispersing 0.2 g of the above blue dye in 1 liter of Whitesol (product of Kyode Petroleum Co.), which is a petroleum hydrocarbon solvent of an aromatic content of 16%, by means of ultrasonic vibration. Particles dispersed in the liquid developer were adsorbed onto a negative electrostatic latent image, forming a blue visible image (positive).

EXAMPLE 16

Example 15 was repeated by employing -b 1-phenyl-3-methyl-5-pyrazolone instead of H acid. The resulting liquid developer gave a yellow visible image (positive).

EXAMPLE 17

Synthesis:

To a solution of 100 g of 1,4-diamino-2-mercaptoanthraquinone in 1000 g of alcohol 120 g of hexadecyl were added. In a reactor equipped with a refluxing cooling tube, the reaction was effected at the boiling point under stirring for 2 hours. The reaction mixture was cooled, and the precipitate was recovered by filtration, washed with alcohol and dried to obtain a waxy product.

The reaction of forming the above waxy product is expressed by the following formula:

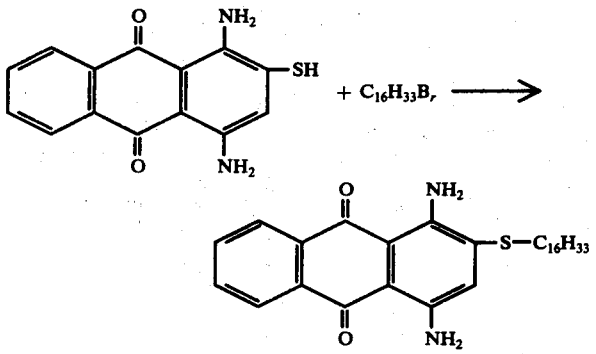

Preparation of Liquid Developer:

A liquid developer was prepared by dispersing 0.2 g of the so formed waxy product in New Sol Delux (product of Nippon Petroleum Co.), which is a petroleum hydrocarbon solvent of an aromatic content of 8.2% by means of ultrasonic vibration. Particles dispersed in the liquid developer were adsorbed onto a negative electrostatic latent image, producing a violet visible image (positive).

EXAMPLE 18

Synthesis:

10 g of stearyl chlorine and 7 g of anhydrous aluminum chloride were dissolved in 50 g of dried carbon tetrachloride, and 5 g of Acid Fast Black BR (C. I. acid black 31; 17580)were added to the solution under stirring while maintaining the temperature of the solution at 10°–15°° C. The reaction was effected at this temperature under stirring for 3 hours. The reaction product was poured into ice water and neutralized with potassium hydroxide, followed by removal of carbon tetrachloride by steam distillation, washing with aqueous potassium hydroxide and drying to form octadecanoyl Acid Fast Black BR. Separately, 10 g of zinc powder were added to a solution of 1 g of mercuric chloride in 20 ml of water and the mixture was shaken for 1.5 hours. The supernatant liquid was removed by decantation and the residue was washed sufficiently with water to obtain amalgamated zinc. A three-neck flask equipped with a refluxing cooling tube and a stirrer was charged with 7 g of the so formed amalgamated zinc, and then 10 ml of water and 7 ml of concentrated sulfuric acid were added thereto. Finally, a solution of 5 g of octadecanoyl Acid Fast Black BR dispersed in 10 ml of alcohol was added to the flask. The reaction was effected for 10 hours under vigorous agitation at the boiling point of the system. Octadecyl Acid Fast Black BR was obtained.

The above reaction of forming octadecyl Acid Fast Black BR is expressed by the following formula:

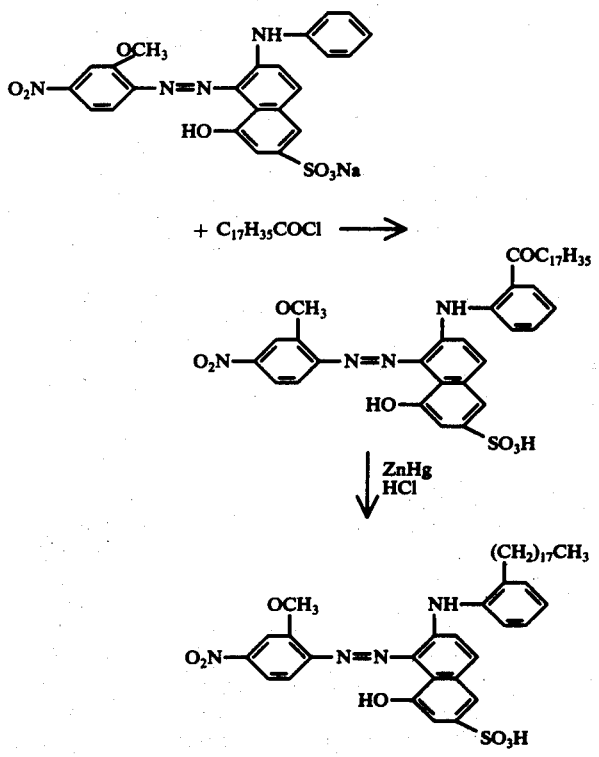

Preparation of Liquid Developer:

A liquid developer was prepared by dispersing 0.2 g of the so formed dye in 1 liter of Whitesol (product of Kyodo Petroleum Co.,), which is a petroleum hydrocarbon solvent of an aromatic content of 16% by means of ultrasonic vibration. Particles of the liquid developer were adsorbed on a negative electrostatic latent image, forming a black visible image (positive). The liquid developer was excellent in dispersibility and image-fixing property.

EXAMPLE 19

A liquid developer prepared by adding 0.2 g of Carbolan Crimson BS (acidic azo dye, product of Imperial Chemical Industries, Ltd., C. I. 18973) of the formula

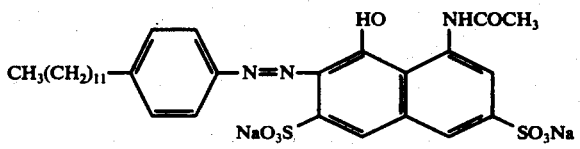

to 1 liter of Isopar G (product of Esso Standard Petroleum Co.), which is an isoparaffin hydrocarbon and subjecting the mixture to ultrasonic vibration for 5 minutes was compared with a liquid developer prepared by adding 0.2 g of the same dye to a mixed solvent of 200 ml of toluene and 800 ml of Isopar G and subjecting the mixture to ultrasonic vibration for 5 minutes. The latter liquid developer was superior to the former with respect to image-distinctiveness, image-fixing property and particle dispersibility. Particles of the latter liquid developer were adsorbed on a negative electrostatic latent image, producing a beautiful red visible positive image of high resolubility.

EXAMPLE 20

0.2 g of a barium pigment of the formula

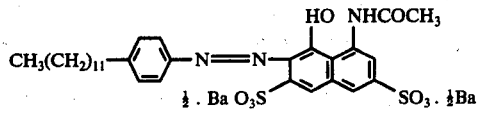

prepared from Carbolan Crimson BS used in Example 19 was added to 200 ml of benzene and dispersed therein by effecting ultrasonic vibration for 5 minutes. The resulting concentrated liquor was diluted with 800 ml of Isopar H (product of Esso Standard Petroleum Co.,), which is an isoparaffin hydrocarbon, to form a dispersion. Particles of the lake pigment were adsorbed on an electrostatic latent image, producing a red visible positive image of high resolubility and good water resistance with little edge effect.

EXAMPLE 21

0.2 g of Carbolan yellow 3 GS of the formula

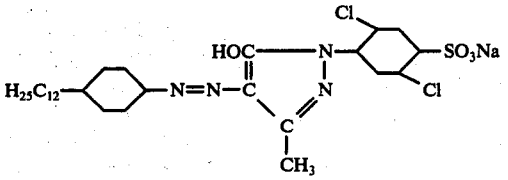

(yellow; acidic azo dye, product of Imperial Chemical Industries Ltd., C. I. 18961) was added to 1 liter of Shellsol 71 (product of Shell Petroleum Co.), which is an isoparaffin hydrocarbon, and the mixture was subjected to ultrasonic vibration for 5 minutes to form a liquid developer consisting of a dispersion of the dye into the hydrocarbon medium. Separately, another liquid developer was prepared by adding the same dye to a mixed solvent of 150 ml of Solvesso 100 (product of Esso Standard Petroleum Co., aromatic solvent) and 850 ml of Shellsol 71 and dispersing the dye in the mixed solvent by conducting ultrasonic vibration for 5 minutes. When both liquid developers were compared, it was found that the latter was superior to the former in image distinctiveness, fixing property and particle dispersibility.

Dye particles of the latter liquid developer were adsorbed on a negatively charged electrostatic latent image, forming a beautiful yellow positive visible image of high resolubility.

EXAMPLE 22

Synthesis:

10 g of a reaction product a 1-amino-2-bromo-4-p-dodecylanilino-anthraquinone and p-n-hexadecyl phenol were charged with 10 g of 100% sulfuric acid into a three neck flask equipped with a thermometer and a stirrer. The reaction was effected at 80° C., and when the reaction mixture was soluble in water, a small amount of fuming sulfuric acid was added thereto, following which the systems was added to water, salted out and filtered. The filtered matter was dissolved again in hot water, and an aqueous solution of barium chloride was added thereto at 50° C. under agitation, and the reaction was performed for 1 hour. The resulting precipitate was separated by filtration and dried to yield a product of the following formula

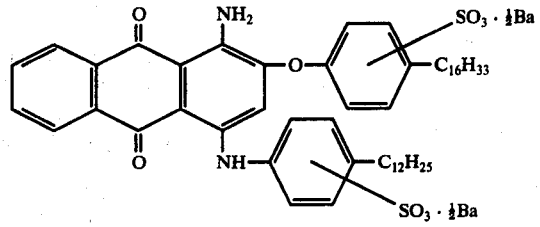

Preparation of Liquid Developer:

A liquid developer was prepared by dispersing 0.2 g of the above synthesized product into a mixed solvent of 200 ml of toluene and 800 ml of Shellsol 71 (isoparaffin hydrocarbon, product of Shell Petroleum Co.) by means of ultrasonic vibration. From this liquid developer a print of a blue visible image of clear contrast was obtained.

EXAMPLE 23

Synthesis:

In a three-neck flask equipped with a thermometer and a stirrer, 10 g of 1-amino-4-bromoanthraquinone-2-sulfonic acid and 15 g of p-dodecylaniline were mixed in 20 g of pyridine. The, 0.2 g of copper acetate and 2.5 g of potassium acetate were added thereto. The reaction was effected in a mantle heater maintained at 115°-120° C. for 24 hours under agitation. At the end of the reaction, the reaction mixture was poured into water and dissolved therein by heating. Insoluble matters were separated by filtration, and the blue filtrate was admixed with an aqueous solution of calcium chloride to lake the dye. The precipitating lake was recovered by filtration, washed with water and dried to yield a blue solid.

The above reaction is expressed by the following formula:

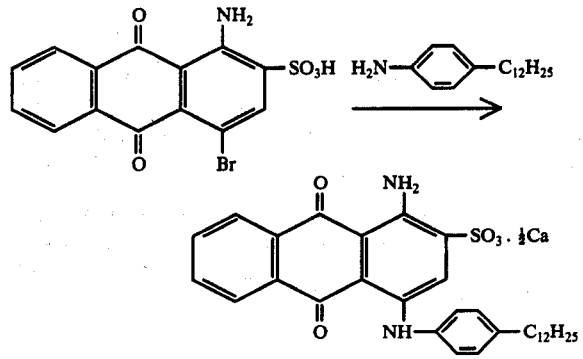

Preparation of Liquid Developer:

A liquid developer was prepared by dispersing 0.2 g of the so formed blue solid into a mixed solvent of 300 ml of toluene and 700 ml of Isopar H (isoparaffin hydrocarbon, product of Esso Standard Petroleum Co.) by means of ultrasonic vibration. The particles dispersed in the liquid developer were absorbed onto a negative electrostatic latent image, producing a print of a blue visible image (positive).

EXAMPLE 24

Synthesis:

20 g of 1,5-dichloroanthraquinone were added to 30 g of fuming sulfuric acid ($SO_3$ content = 40%), followed by agitation for 1 hour. Then, 10 g of fuming sulfuric acid ($SO_3$ content = 60%) were added to the mixture within a period of time of 10 minutes and agitation was effected at 120° C. for 4 hours. Thereafter, the temperature of the mixture was lowered below 10° C. and it was poured into 200 cc of water and 100 g of ice, followed by removal of the unreacted anthraquinone by filtration. To the remaining transparent liquor 7 g of potassium chloride were added to perform the salting out, followed by filtration and water-washing to yield a potassium salt of 1,5-dichloroanthraquinone-4,8-disulfonic acid.

2 g of the so obtained potassium salt of 1,5-dichloroanthraquinone-4,8-disulfonic acid were charged together with 33 g of stearyl-amine, 1.3 g of sodium acetate, 0.3 g of copper acetate and 3.2 g of pyridine into a three-neck flask equipped with a thermometer and a stirrer, and the reaction was effected for 15 hours under agitation in a mantle heater maintained at 80° C. At the end of the reaction the reaction mixture was poured into water and insoluble matters were separated by filtration. The laking of the resulting dye was effected by addition of an aqueous solution of barium chloride and the precipitating red product was recovered by filtration, washed with water and dried.

The above reaction is expressed by the following formula:

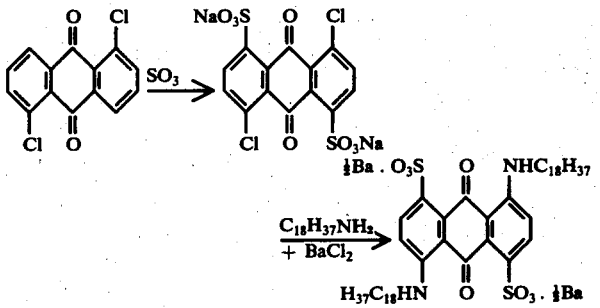

Preparation of Liquid Developer:

A liquid developer was prepared by dispersing 0.2 g of the so formed lake into a mixed solvent of 200 ml of xylene and 800 ml of Isopar H (isoparaffin hydrocarbon, product of Esso Standard Petroleum Co.) by means of ultrasonic vibration. The resulting liquid developer was excellent in dispersibility of particles and the particles were absorbed onto a negative electrostatic latent image, forming a beautiful pink visible image (positive) of good fixing property.

EXAMPLE 25

Synthesis:

An aqueous solution of a violet dye prepared by coupling a diagatized product of octadecylaniline with H acid in an alkaline medium was heated at 50° C., and an aqueous solution of potassium chloride was added thereto under agitation. The mixture was stirred for 1 hour at 50° C., following which the resulting precipitate was recovered by filtration, washed with water and dried to yield a red product of the following formula:

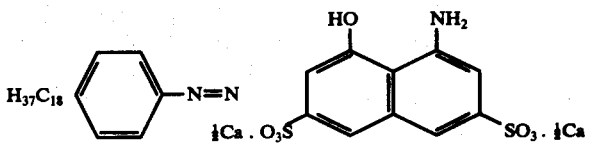

Preparation of Liquid Developer:

A liquid developer was prepared by dispersing 0.2 g of the so formed red product into a mixed solvent of 150 ml of Solvesso 100 (aromatic hydrocarbon solvent, product of Esso Standard Petroleum Co.) and 850 ml of Shellsol 72 (isoparaffin hydrocarbon, product of Shell Petroleum Co.) by operating a homogenizing mixer for 10 minutes. The particles dispersed in the so formed liquid developer were absorbed onto a negative electrostatic latent image, forming a distinct red visible image (positive).

What we claim is:

1. A liquid developer for electrophotography which consists essentially of a dispersion of an anthraquinone dye or pigment finely dispersed in an electrically insulating hydrocarbon liquid consisting essentially of isoparaffinic hydrocarbon selected from the group consisting of a mixture consisting substantially of isoparaffins containing from 9 to 11 carbon atoms and having a boiling point range of from about 320° F to about 350° F, a mixture consisting substantially of isoparaffins containing 8 to 12 carbon atoms and having a boiling point range of from about 345° F to about 375° F and a mixture consisting substantially of isoparaffins containing 9 to 14 carbon atoms and having a boiling point range of from about 354° F to about 386° F, and from 0 to 30% by volume of an aromatic hydrocarbon in which the anthraquinone dye or pigment is substantially insoluble said anthraquinone dye or pigment have the formula:

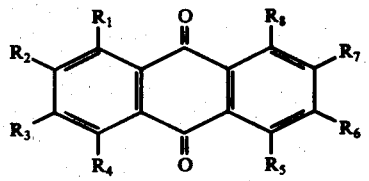

wherein $R_1$ to $R_8$ are selected from hydrogen, halogen, hydroxyl, amino, $-SO_3M$, in which M is hydrogen, an alkali metal or an alkaline earth metal, and a substituent of the group consisting of a. an alkyl group,
b. an alkoxy group,
c. an alkylthio group,
d. an alkylamino group,
e. an alkylcarbonyl group,
f. an N-alkylcarbonamide group,
g. an N-alkylsulfonamide group,
h. an alkarylamino group,
i. an N-alkarylcarbonamide group,
j. an N-alkarylsulfonamide group, k. an alkylbenzenesulfonamide group,
l. an alkylarylamino group,
m. an alkylamino-triazinylamino group, and
n. an alkaryloxy group, each of the above groups (a) to (n) having 8 to 24 carbon atoms in the alkyl portion, and wherein 1 to 4 of $R_1$ to $R_8$ are substituents selected from the said groups (a) to (n);

and from 0 to 30% by volume of an aromatic hydrocarbon, the liquid developer containing 0.05 to 5 grams of said dye or pigment per liter of said liquid developer.

2. The liquid developer according to claim 1 which contains from 5 to 30% by volume of an aromatic hydrocarbon.

3. The liquid developer of claim 1 wherein said dye is

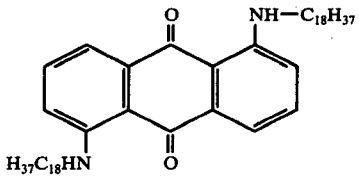

4. The liquid developer of claim 1 wherein said dye is

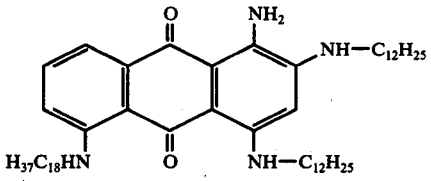

5. The liquid developer of claim 1 wherein said dye is

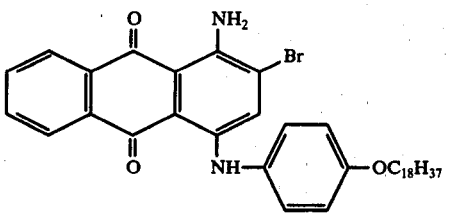

6. The liquid developer of claim 1 wherein said dye is

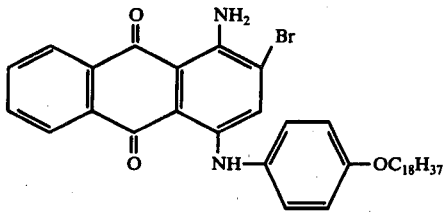

7. The liquid developer of claim 1 wherein said dye is

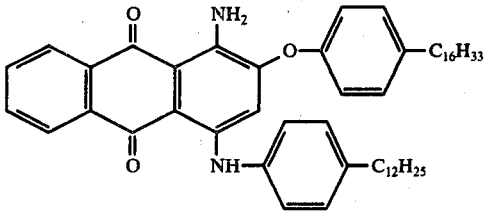

8. The liquid developer of claim 1 wherein said dye is

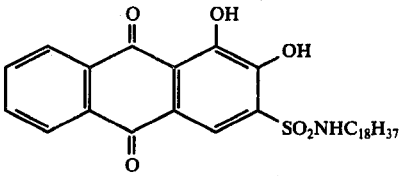

9. The liquid developer of claim 1 wherein said dye is

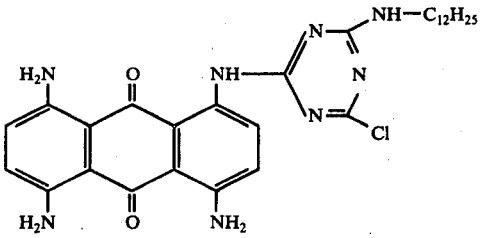

10. The liquid developer of claim 1 wherein said dye is

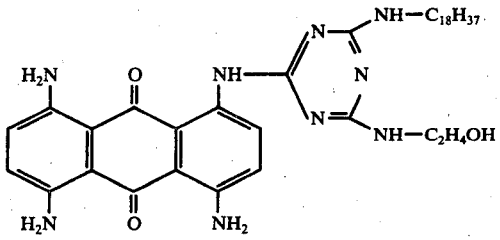

11. The liquid developer of claim 1 wherein said dye is

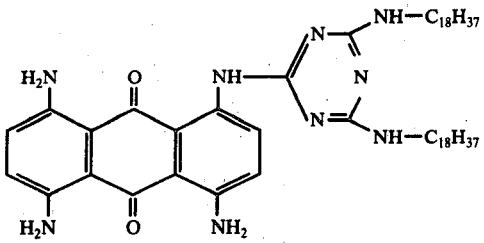

12. The liquid developer of claim 1 wherein said dye is

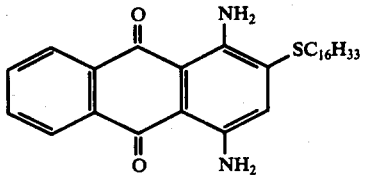
13. The liquid developer of claim 1 wherein said pigment is
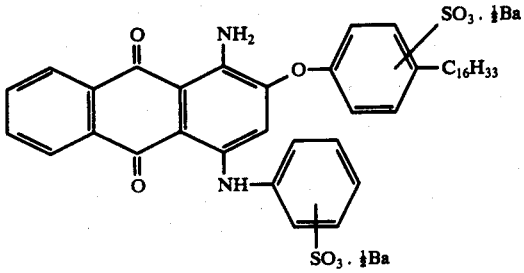
14. The liquid developer of claim 1 wherein said pigment is
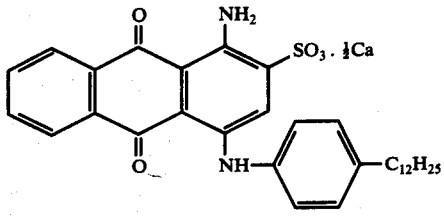
15. The liquid developer of claim 1 wherein said pigment is
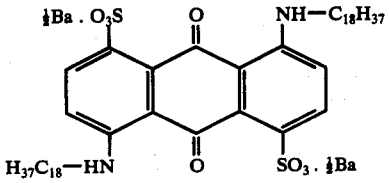
16. The liquid developer of claim 2 wherein said aromatic hydrocarbon is selected from the group consisting of benzene, toluene and xylene.
* * * * *

UNITED STATES PATENT OFFICE

CERTIFICATE OF CORRECTION

Patent No. 4,051,052 Dated September 27, 1977

Inventor(s) Yasuo Ueda et al.

It is certified that error appears in the above-identified patent and that said Letters Patent are hereby corrected as shown below:

Claim 5, in the formula, delete "$-OC_{18}H_{37}$" and insert -- $-C_{18}H_{37}$ --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*